US006626004B2

(12) United States Patent
Lee

(10) Patent No.: US 6,626,004 B2
(45) Date of Patent: Sep. 30, 2003

(54) DEFROSTER FOR EVAPORATOR OF REFRIGERATOR

(75) Inventor: Won-Bok Lee, Gimhae (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/315,148

(22) Filed: Dec. 10, 2002

(65) Prior Publication Data

US 2003/0115899 A1 Jun. 26, 2003

(30) Foreign Application Priority Data

Dec. 21, 2001 (KR) ..... 2001-0082964

(51) Int. Cl.[7] ..... F25D 21/06
(52) U.S. Cl. ..... 62/276; 62/80; 392/480
(58) Field of Search ..... 62/275, 276, 80; 165/179; 392/479, 480, 482

(56) References Cited

U.S. PATENT DOCUMENTS 3,922,874 A * 12/1975 Canter ..... 62/155
4,061,482 A * 12/1977 Smith ..... 62/155
4,332,142 A * 6/1982 Prada ..... 62/152
4,358,933 A * 11/1982 Horvay ..... 62/155
4,843,833 A * 7/1989 Polkinghorne ..... 62/180
5,017,760 A * 5/1991 Miller ..... 219/390
5,028,243 A * 7/1991 Rubey ..... 95/87
5,086,831 A * 2/1992 Paikert et al. ..... 165/47
5,251,454 A * 10/1993 Yoon ..... 62/156
5,448,678 A * 9/1995 Booton et al. ..... 392/480
5,545,878 A * 8/1996 Jasper et al. ..... 219/541
5,552,581 A * 9/1996 Jasper et al. ..... 219/523

FOREIGN PATENT DOCUMENTS

JP 2002195735 * 7/2002 ..... F25D/21/08

* cited by examiner

*Primary Examiner*—William E. Tapolcai
*Assistant Examiner*—Mohammad M. Ali
(74) *Attorney, Agent, or Firm*—Fleshner & Kim, LLP

(57) ABSTRACT

The present invention relates to a defroster for an evaporator of a refrigerator. A defrosting heater 34 is installed close to a refrigerant tube 32 in which a refrigerant flows. The defrosting heater 34 is constructed to generate different amounts of heat according to positions in an evaporator 30. To this end, a hot wire 44 of the defrosting heater 34 has different wound pitches according to the positions in the evaporator 30. For example, the pitch of the hot wire 44 on an inlet side through which air that has circulated in the refrigerator is introduced toward the evaporator 30 is set to be small in order to generate a relatively large amount of heat. Since air that has circulated in a refrigerating chamber of the refrigerator entrains a relatively large amount of moisture, the pitch of the hot wire 44 is relatively small at a region in the evaporator 30 by which air that has circulated in the refrigerating chamber passes. According to the present invention, defrosting of the evaporator 30 can be smoothly performed, and heat generated from the defrosting heater 34 can be prevented from being transferred into the refrigerating chamber.

5 Claims, 2 Drawing Sheets

DEFROSTER FOR EVAPORATOR OF REFRIGERATOR

BACKGROUND OF THE INVENTION

1. Field of the Invention

The present invention relates to a defroster for a refrigerator, and more particularly, to a defroster for an evaporator of a refrigerator for eliminating frost formed on the evaporator by causing calorific values to vary according to positions in the evaporator.

2. Description of the Prior Art

Cold air which circulates in a refrigerator and performs cooling and freezing actions is generated through heat exchange with a refrigerant in a heat exchange cycle of an evaporator of the refrigerator. Moisture absorbed into the cold air during the circulation of the cold air in the refrigerator adheres on a surface of the evaporator, which is in a relatively low temperature state, and is formed into frost thereon. If the frost grows and becomes ice with a thickness exceeding a certain thickness, the ice disturbs the flow of the cold air passing by the evaporator. This results in fatal hindrance to a heat exchange efficiency of the evaporator.

In order to solve the problem, a defrosting process is periodically performed at a predetermined time interval. Generally, such a defrosting process is carried out by operating a heater installed at the evaporator.

As shown in FIG. 1, a general evaporator 1 includes a refrigerant tube 2 which is arranged in a serpentine state in a vertical direction and through which a low-temperature and low-pressure refrigerant flows. A heater 4 is also arranged in the serpentine state in the vertical direction in the same manner as the refrigerant tube 2. The refrigerant tube 2 and the heater 4 are supported by supporting plates 5 provided at both the right and left ends of the evaporator 1. A plurality of heat radiation fins 6 are added to the refrigerant tube 2 between the supporting plates 5 so as to facilitate the heat exchange in the refrigerant tube.

Meanwhile, FIG. 2 shows the inner constitution of the heater. As shown in the figure, a heater tube 7 made of aluminum defines an external appearance of the heater 4. A hot wire 8 is wound at a predetermined interval within the heater tube 7. The hot wire 8 radiates heat when electric power is applied thereto, and is wound on an outer periphery of a core 9 and covered with an insulating cover 10. That is, the heater 4 is constructed in such a manner that the hot wire 8 wound on the core 9 and covered with the insulating cover 10 is disposed within the heater tube 7.

Crimped terminals 11 are provided at both ends of the heater tube 7 of the heater 4, and the hot wire 8 is connected to lead wires 12 provided on outer sides of the crimped terminals 11 and thus is supplied with electric power from the outside.

However, the aforementioned prior art has the following problem.

In the conventional heater 4, the hot wire 8 is wound at a uniform interval as a whole. Therefore, when the hot wire 8 radiates heat, an almost identical amount of heat is radiated from all regions of the heater tube 7.

However, frost with a uniform thickness is not always formed and grows throughout all regions of the evaporator 1. For example, it is apparent that a large amount of air comes into contact with a portion of the evaporator into which the air that has circulated in the refrigerator is introduced through a return duct, and a large amount of frost is thus formed and grows on the portion of the evaporator. On the contrary, a small amount of frost is formed and grows on outer portions of the supporting plates 5.

In spite of the different amounts of the frost formed on respective portions of the evaporator 1, if a uniform amount of heat is radiated throughout the heater 4, this causes a problem. That is, a portion where the large amount of frost is formed cannot be efficiently defrosted, and at the same time, heat from a frost-free portion is conducted to the inside of the refrigerator and thus it is likely that the temperature of the interior of the refrigerator may be substantially increased.

SUMMARY OF THE INVENTION

An object of the present invention is to provide a defroster capable of most efficiently performing a defrosting process with optimum electric power.

According to the present invention for achieving the object, there is provided a defroster for an evaporator of a refrigerator, comprising a refrigerant tube arranged repeatedly at a predetermined interval so as to allow a refrigerant flowing therein to evaporate and absorb heat from the surroundings; a plurality of heat radiation fins installed to be in contact with an outer periphery of the refrigerant tube for enlarging a heat exchange area; and a defrosting heater for generating heat to eliminate frost formed on an outer surface of the refrigerant tube and the heat radiation fins. Pitches of a wound hot wire provided in the defrosting heater are set to be different from one another at respective regions of the defrosting heater according to the amount of frost to be formed.

The pitch of the wound hot wire on an inlet side through which air that has circulated in the refrigerator is introduced for heat exchange toward the evaporator is preferably smaller than that on an outlet side through which the air leaves the evaporator.

The pitch of the wound hot wire at a portion of the defrosting heater by which air that has circulated in a refrigerating chamber of the refrigerator passes is preferably smaller than that at a portion of the defrosting heater by which the air that has circulated in a freezing chamber of the refrigerator passes.

The defrosting heater may be constructed by winding the hot wire around a core at the predetermined pitches, covering the hot wire wound around the core with an insulating cover, and inserting the covered hot wire and core into a heater tube.

The defrosting heater may be further provided with non-heating regions where heat is not radiated, by causing conductors to be connected in parallel with the hot wire.

With the constitution of the present invention, there are advantages in that maximum defrosting performance can be achieved with optimum electric power and heat generated during the defrosting process can be simultaneously prevented from being introduced into the interior of the refrigerator.

BRIEF DESCRIPTION OF THE DRAWINGS

The above and other objects, advantages and features of the present invention will become apparent from the following description of a preferred embodiment given in conjunction with the accompanying drawings, in which.

DETAILED DESCRIPTION OF THE INVENTION

Hereinafter, the present invention will be described in detail in connection with a preferred embodiment shown in the accompanying drawings.

Figure 1:
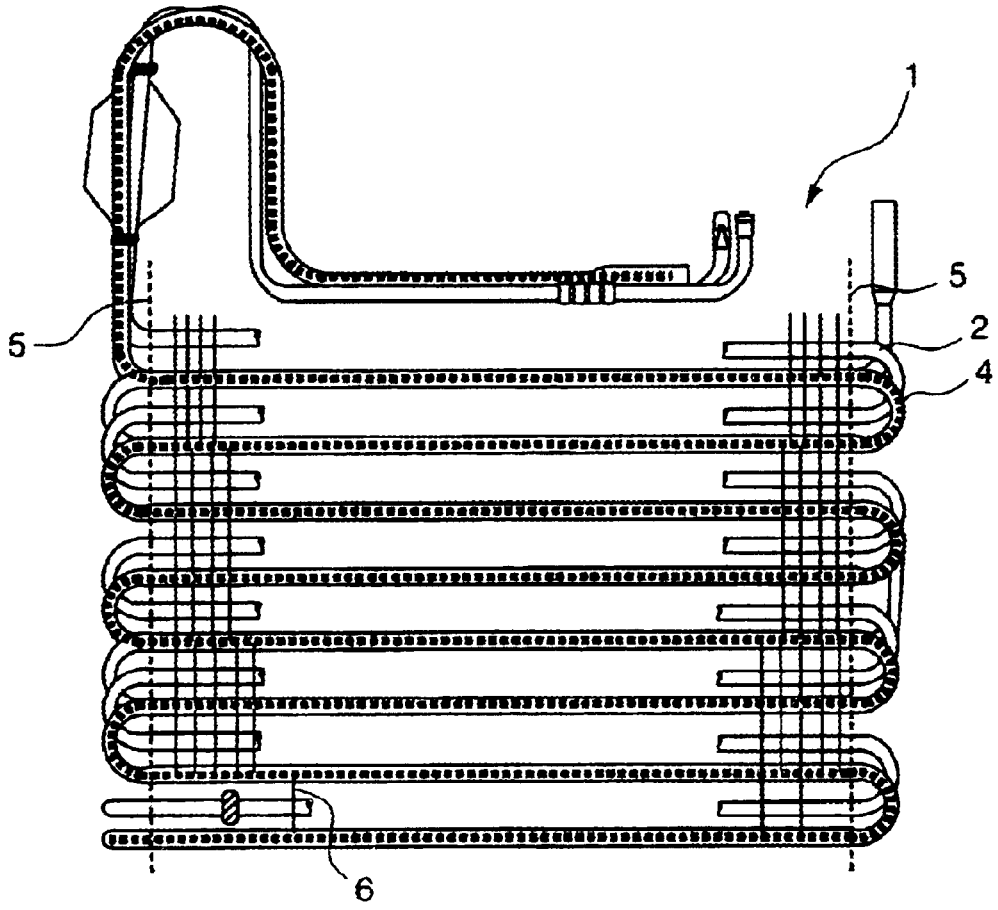
FIG. 1 Prior Art
FIG. 1 is a partially cut-away front view showing an essential constitution of a conventional evaporator.
Figure 2:
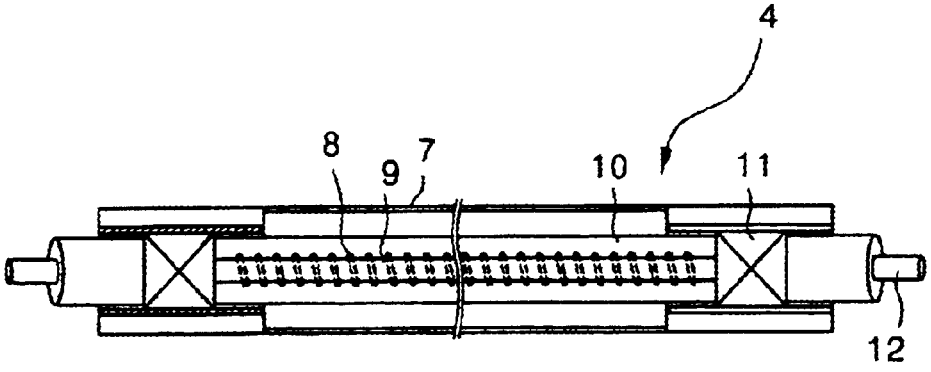
FIG. 2 Prior Art
FIG. 2 is a partial sectional view showing the constitution of a conventional defrosting heater.
Figure 3:
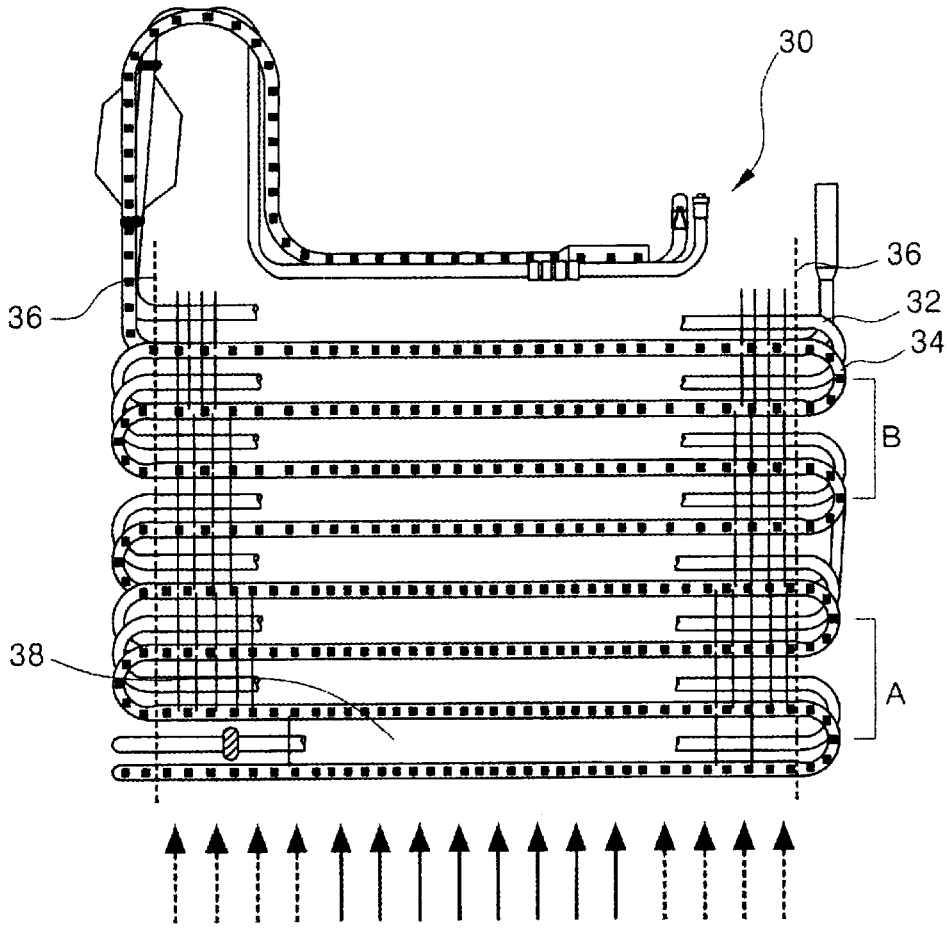
FIG. 3 is a partially cut-away front view showing a preferred embodiment of a defroster for an evaporator of a refrigerator according to the present invention.
Figure 4:
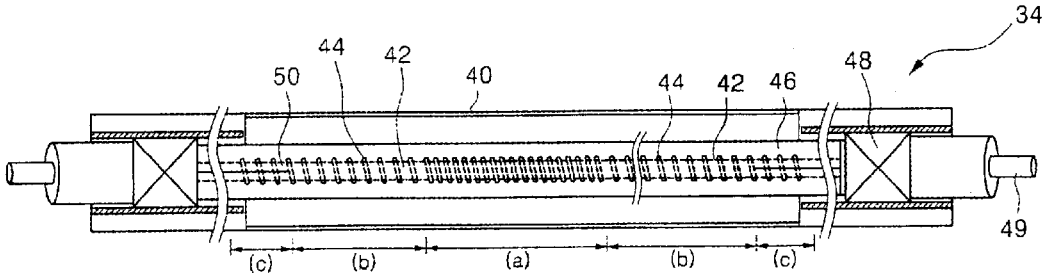
FIG. 4 is a partial sectional view showing the constitution of a defrosting heater according to the embodiment of the present invention.

FIG. 3 is a partially cut-away front view showing a preferred embodiment of a defroster for an evaporator of a refrigerator according to the present invention, and FIG. 4 is a partial sectional view showing the constitution of a defrosting heater according to the embodiment of the present invention.

As shown in the figures, an evaporator 30 includes a refrigerant tube 32 which is bent in a serpentine form such that it extends laterally with a predetermined vertical interval A liquid refrigerant flows in the refrigerant tube 32, performs heat exchange with air that has flowed in the refrigerator, and is then evaporated. At this time, the flow direction of the air is perpendicular to the extension direction of the refrigerant tube 32.

A defrosting heater 34 is provided along the refrigerant tube 32. The defrosting heater 34 is installed close to and along the refrigerant tube 32 and supplies heat for eliminating frost formed on an outer surface of the refrigerant tube 32. Supporting plates 36 for supporting the refrigerant tube 32 and the defrosting heater 34 are provided at both ends of the evaporator 30. The heat exchange substantially occurs at portions of the refrigerant tube 32 disposed between the supporting plates 36 provided at both the ends of the evaporator.

Heat radiation fins 38 are provided on an outer surface of the refrigerant tube 32. A plurality of the heat radiation fins 38 are arranged at a predetermined interval in a direction of the flow of the air which passes by the evaporator 30. Thus, the air passing by the evaporator 30 flows between the heat radiation fins 38 and performs the heat exchange.

Next, the constitution of the defrosting heater 34 will be explained. A heater tube 40 defines an external appearance of the defrosting heater 34. The heater tube 40 is formed out of a metal material with high heat conductivity such as aluminum. The heater tube 40 is installed at a position close to the refrigerant tube 32, and is bent plural times in the serpentine form in the same manner as the refrigerant tube 32. The heater tube 40 is also supported by the supporting plates 36.

A core 42 is provided in the heater tube 40 and a hot wire 44 is wound on an outer periphery of the core 42. Pitches of the wound hot wire 44 are set differently according to positions in the evaporator 30.

That is, in the present embodiment, a region with a relatively small pitch of the heat wire 44 is referred to as a first heat radiating region a, regions with a relatively slightly small pitch are referred to as second heat radiating regions b, and regions from which the heat is not radiated are referred to as non-heating regions c. Of course, there may be a region in which the hot wire 44 is wound at a pitch different from those of the first and second heat radiating regions a and b.

In such a way, caloric values in the respective regions can be set differently from one another by making the pitches of the hot wire 44 be different from one another in the respective regions. Such constitution is intended to ensure sufficient heat radiation at a portion of the evaporator 30 where a large amount of frost is formed and to generate a relatively small amount of heat at a portion of the evaporator where a small amount of frost is formed.

Meanwhile, an insulating cover 46 is provided to cover the hot wire 44 wound on the core 42. The insulating cover 46 serves to insulate the hot wire 44 and the heater tube 40 from each other. At portions corresponding to both ends of the defrosting heater 34, crimped terminals 48 are connected to the hot wire 44 and disposed within the heater tube 40, and lead wires 49 are connected to the crimped terminals 48 and protrude toward the exterior of the heater tube 40. The lead wires 49 serve to supply the external electric power to the hot wire 44.

Next, each of the non-heating regions c is constructed by causing a conductor 50 made of a metal material with superior conductivity to be connected in parallel with an outer portion of the hot wire 44 which has constant resistance and is wound on the core 42. If necessary; the non-heating regions may be formed, for example, even at both ends of the defrosting heater 34 and at portions corresponding to outer sides of the supporting plates 36.

Hereinafter, the pitches of the hot wire 44 wound in the respective regions of the evaporator 30 of the present invention will be discussed with reference to FIG. 3. In the present embodiment, air passes by the evaporator 30 upwardly as denoted by arrows in FIG. 3. Here, air that has circulated in a freezing chamber of the refrigerator is introduced toward both lower side ends of the evaporator, whereas air that has circulated in a refrigerating chamber of the refrigerator is introduced toward a lower central portion of the evaporator 30. In such a way, the air introduced from the lower portion of the evaporator leaves an upper portion of the evaporator 30. At this time, the air becomes cold air by the heat exchange while passing through the evaporator 30.

In the case where such an air flow through the evaporator 30 is formed, the pitches of the hot wire 44 are set such that the pitch of the hot wire in the lower portion of the evaporator 30 is smaller than that in the upper portion of the evaporator. This is because the heat exchange of the air, which has circulated in the refrigerator, first occurs at the lower portion of the evaporator 30.

Further, since the air that has circulated in the refrigerating chamber and is introduced toward the evaporator 30 (solid arrows in FIG, 3) entrains a relatively large amount of moisture over the air that has circulated in the freezing chamber and is introduced toward the evaporator 30 (dotted arrows in FIG. 3), a large amount of frost is formed on the central portion of the evaporator 30 rather than both side ends thereof in the present embodiment. Therefore, the pitch of the hot wire 44 at the central portion of the evaporator is relatively smaller than those at the both side ends of the evaporator 30, i.e. both side ends of the air flow passing by the evaporator 30.

It will be apparent that in a case where the introduction directions of the air that has circulated in the freezing and refrigerating chambers toward the evaporator 30 are different from those in the present invention, the pitches of the hot wire 44 should be set to be suitable for the amounts of frost formed at the respective portions of the evaporator 30.

Alternatively, as to the defrosting heater 32, a defrosting heater of which a heater tube is made of glass material or a sheath heater may also be used in addition to that described in the present embodiment. In such a case, caloric values at the respective regions of the defrosting heater 32 should be set to be different from one another according to a flow of the air passing by the evaporator.

Hereinafter, a defrosting process performed according to the present invention will be described.

The refrigerator performs a defrosting operation for eliminating frost after the operation of a heat exchange cycle for a predetermined period of time. The frost formed on the evaporator 30 is eliminated through the defrosting operation so that the heat exchange in the evaporator 30 can be further facilitated. To this end, the defrosting heater 32 is operated to generate heat so that the frost is melted and finally eliminated.

Here, the pitches of the hot wire 44 which are denoted on the defrosting heater 34 in FIG. 3 will be discussed. It can be seen that the pitches are smaller from the upper portion to the lower portion of the evaporator 30 and from both the side ends to the central portion of the evaporator 30. That is, it can be understood that the pitch of the hot wire 44 is small at the portion where a large amount of frost is formed in view of the flow of the air passing by the evaporator 30.

More specifically, the air that has circulated in the refrigerator is supplied to the lower portion of the evaporator 30 and first comes into contact with the heat radiation fins 38 or refrigerant tube 32 at a lower end of the evaporator 30 to be heat exchanged therewith. Thus, the amount of the frost is always maximized at the lower end A of the evaporator 30. Further, in the lower end A of the evaporator, the frost is first formed at the central portion of the lower end. If the frost grows to such an extent that the central portion is blocked, it gradually expands toward the outside and finally grows up to both the lower side ends of the evaporator 30.

However, in a region of the defrosting heater 34 corresponding to the lower end A of the evaporator, the pitch of the hot wire 44 is set to be relatively small such as in the first heat radiating region a of FIG. 4, so that sufficient heat radiation can be made during the defrosting process.

An upper end B of the evaporator 30 is a portion where a relatively small amount of frost is formed. Therefore, in a region of the defrosting heater 34 corresponding to the upper end, the pitch of the hot wire 44 is set to be relatively large as shown in the second heat radiating regions b of FIG. 4. Accordingly, heat radiation suitable for the amount of formed frost can be achieved.

Meanwhile, the air that has circulated in the refrigerating chamber entrains a relatively large amount of moisture over the air that has circulated in the freezing chamber. Further, the cold air that has circulated in the freezing chamber passes by the evaporator 30 through the lower side ends of the evaporator 30 as denoted by the dotted arrows in FIG. 3, whereas the cold air that has circulated in the refrigerating chamber passes by the evaporator 30 through the lower central portion of the evaporator 30 as denoted by the solid arrows in FIG. 3.

Therefore, the pitch of the hot wire 44 is set to be relatively large at the portion of the defrosting heater 34 corresponding to the side ends of the evaporator 30 and to be relatively small at the portion of the defrosting heater corresponding to the central portion of the evaporator 30 so that the defrosting process can be properly performed.

It can be understood that the frost formed on the evaporator can be eliminated most efficiently according to the present invention. That is, it is possible to make a calorific value relatively large at the portion of the evaporator where a large amount of frost is formed and small at the portion of the evaporator where a small amount of frost is formed. Thus, since the frost can be eliminated most efficiently with an efficient calorific value, it can be expected to obtain effects that power consumption can be optimized and heat generated from the heater can be prevented from penetrating into the refrigerator.

It will be understood by those skilled in the art that various changes or modifications may be made to the present invention without departing from the technical spirit and scope of the invention. Therefore, the present invention should be construed based on the appended claims.

What is claimed is:

1. A defroster for an evaporator of a refrigerator, comprising:

a refrigerant tube arranged repeatedly at a predetermined interval so as to allow a refrigerant flowing therein to evaporate and absorb heat from the surroundings;

a plurality of heat radiation fins installed to be in contact with an outer periphery of the refrigerant tube for enlarging a heat exchange area; and a defrosting heater for generating heat to eliminate frost formed on an outer surface of the refrigerant tube and the heat radiation fins, wherein pitches of a wound hot wire provided in the defrosting heater are set to be different from one another at respective regions of the defrosting heater according to the amount of frost to be formed.

2. The defroster as claimed in claim 1, wherein the pitch of the wound hot wire on an inlet side through which air that has circulated in the refrigerator is introduced for heat exchange toward the evaporator is smaller than that on an outlet side through which the air leaves the evaporator.

3. The defroster as claimed in claim 1, wherein the pitch of the wound hot wire at a portion of the defrosting heater by which air that has circulated in a refrigerating chamber of the refrigerator passes is smaller than that at a portion of the defrosting heater by which the air that has circulated in a freezing chamber of the refrigerator passes.

4. The defroster as claimed in claim 3, wherein the defrosting heater is constructed by winding the hot wire around a core at the predetermined pitches, covering the hot wire wound around the core with an insulating cover, and inserting the covered hot wire and core into a heater tube.

5. The defroster as claimed in claim 4, wherein the defrosting heater is further provided with non-heating regions where heat is not radiated, by causing conductors to be connected in parallel with the hot wire.

* * * * *